US012740624B2

(12) United States Patent
Hudgin

(10) Patent No.: US 12,740,624 B2
(45) Date of Patent: Sep. 22, 2026

(54) PORTABLE WORK DESK DEVICE

(71) Applicant: Tammy Hudgin, Bond Head (CA)

(72) Inventor: Tammy Hudgin, Bond Head (CA)

( * ) Notice: Subject to any disclaimer, the term of this patent is extended or adjusted under 35 U.S.C. 154(b) by 47 days.

(21) Appl. No.: 18/817,428

(22) Filed: Aug. 28, 2024

(65) Prior Publication Data

US 2026/0060395 A1 Mar. 5, 2026

(51) Int. Cl.

| | |
|---|---|
| ***A45C 9/00*** | (2006.01) |
| ***A45C 3/02*** | (2006.01) |
| ***A45C 15/06*** | (2006.01) |
| ***A47B 1/04*** | (2006.01) |
| ***A47B 3/10*** | (2006.01) |
| ***A47B 21/03*** | (2006.01) |
| ***A47B 21/06*** | (2006.01) |

(52) U.S. Cl.

CPC ..... *A45C 9/00* (2013.01); *A45C 3/02* (2013.01); *A45C 15/06* (2013.01); *A47B 1/04* (2013.01); *A47B 3/10* (2013.01); *A47B 21/0314* (2013.01); *A47B 21/06* (2013.01); *A47B 2021/0335* (2013.01); *A47B 2220/0077* (2013.01)

(58) Field of Classification Search

CPC .. A45C 3/02; A45C 9/00; A45C 15/06; B47B 1/04; B47B 3/10; B47B 21/0314; A47B 1/04; A47B 2220/0077; A47B 21/0314

USPC ..... 190/11

See application file for complete search history.

(56) References Cited

U.S. PATENT DOCUMENTS

| | | | | |
|---|---|---|---|---|
| 5,242,056 | A * | 9/1993 | Zia | A45C 15/00 190/110 |
| 6,811,006 | B1 | 11/2004 | Mundle | |
| D598,671 | S | 8/2009 | Gagnon, Jr. | |
| 7,819,247 | B2 | 10/2010 | Gonzalez | |
| 7,870,937 | B1 * | 1/2011 | Arnao | A45C 9/00 190/15.1 |
| 8,616,354 | B2 | 12/2013 | Azirian | |
| 2002/0023811 | A1 | 2/2002 | Silvano | |
| 2020/0163426 | A1 | 5/2020 | Ungar | |
| 2022/0071386 | A1 | 3/2022 | Hanks | |
| 2024/0049851 | A1 | 2/2024 | Gillam | |

FOREIGN PATENT DOCUMENTS

| | | |
|---|---|---|
| WO | WO2023039230 | 3/2023 |

* cited by examiner

*Primary Examiner* — Sue A Weaver

(57) ABSTRACT

A portable work desk device includes a briefcase comprising a bottom shell hingedly coupled to a top shell. A work table is hingedly attached to the bottom shell of the briefcase to enable the user to position the laptop computer on the work table. A pair of extension tables is each slidably attached to the work table and can be extended laterally beyond the work table in opposite directions from each other to support work related objects of the user. A plurality of legs is each pivotally attached to the bottom shell of the briefcase. Each of the plurality of legs is positionable in a deployed position to support the bottom shell above a support surface. Each of the plurality of legs is positionable in a stored position having the plurality of legs resting against the bottom shell.

11 Claims, 6 Drawing Sheets

PORTABLE WORK DESK DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to work desk devices and more particularly pertains to a new work desk device for transporting a laptop computer and facilitating a portable work station for the laptop computer. The device includes a briefcase and a work table hingedly disposed in the briefcase and a pair of extension tables each slidably attached to the work table. Each of the extension tables is slidably laterally away from the work table in opposite directions from each other to define a work station that enables the laptop computer to be placed upon the work table. The device includes a plurality of legs that are each pivotally attached to the briefcase which can be deployed to support the briefcase above a support surface.

(2) Description of Related Art Including Information Disclosed Under 37 CFR 1.97 and 1.98

The prior art relates to work desk devices including a convertible briefcase device that includes a briefcase and a work table hingedly disposed in the briefcase and a plurality of legs, each attached to the briefcase, for supporting the briefcase above a support surface; a pair of convertible briefcase devices that each at least includes a briefcase and legs attached to the briefcase for supporting the briefcase above a support surface and a pair of extension tables that are each slidably integrated into the briefcase which can be extended laterally from the briefcase; a barber briefcase device that includes a briefcase and legs attached to the briefcase to support the briefcase above a support surface and a pair of extension tables each pivotally attached to the briefcase which can be pivoted to extend laterally away from the briefcase. In no instance does the prior art disclose a portable work station device that includes a briefcase and a work table pivotally disposed in the briefcase and a pair of extension tables that are each slidably attached to the work table which can each be positioned to extend laterally away from the work table in opposite directions from each other and a light positioned in the briefcase for illuminating the work table.

(h) BRIEF SUMMARY OF THE INVENTION

An embodiment of the disclosure meets the needs presented above by generally comprising a briefcase comprising a bottom shell hingedly coupled to a top shell. A work table is hingedly attached to the bottom shell of the briefcase to enable the user to position the laptop computer on the work table. A pair of extension tables is each slidably attached to the work table and can be extended laterally beyond the work table in opposite directions from each other to support work related objects of the user. A plurality of legs is each pivotally attached to the bottom shell of the briefcase. Each of the plurality of legs is positionable in a deployed position to support the bottom shell above a support surface. Each of the plurality of legs is positionable in a stored position having the plurality of legs resting against the bottom shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(J) DETAILED DESCRIPTION OF THE INVENTION

Figure 1:
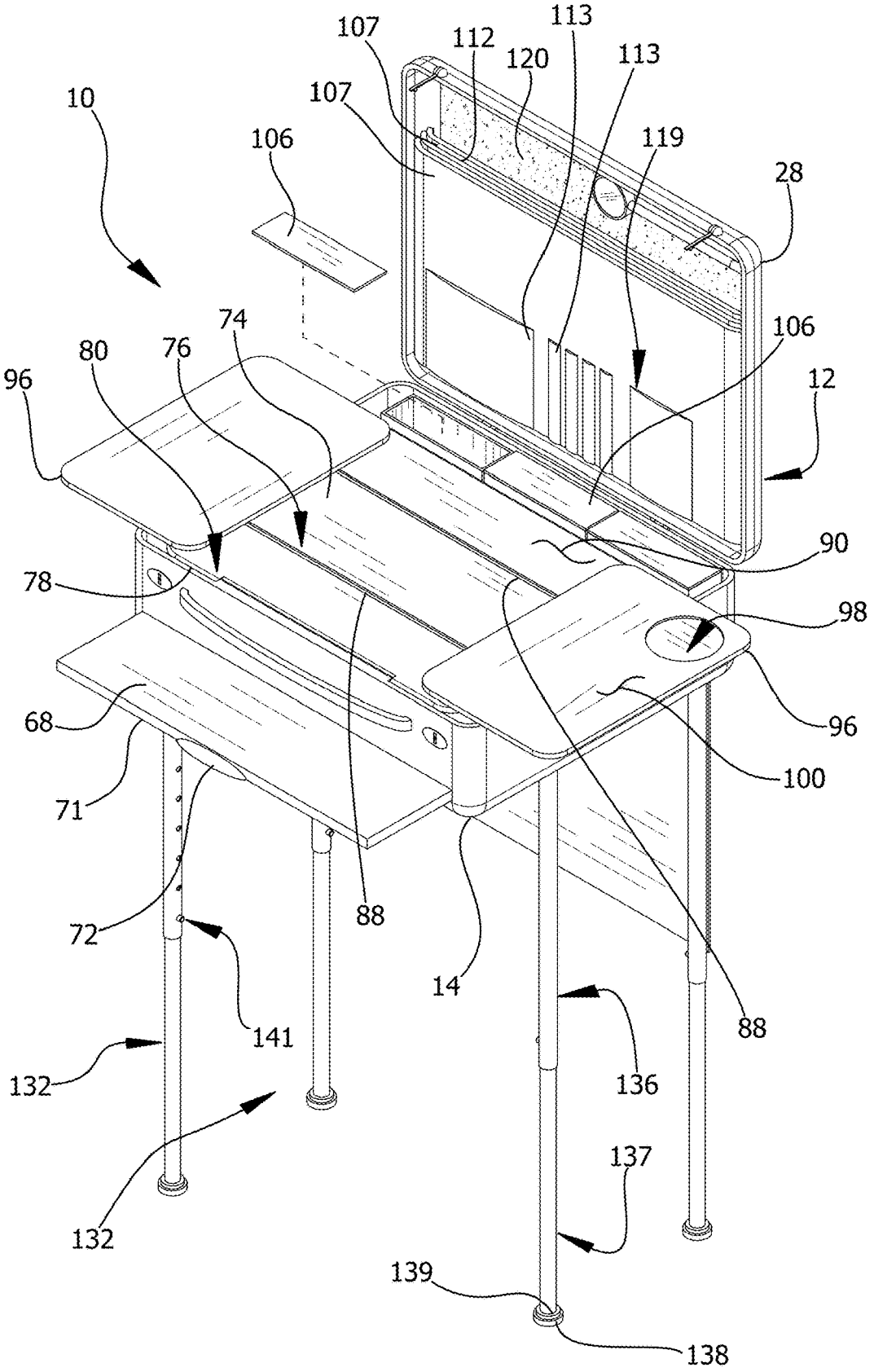
FIG. 1 is a top perspective view of a portable work desk device according to an embodiment of the disclosure showing a work table in a first position and a pair of extension tables each positioned in a deployed position.
Figure 2:
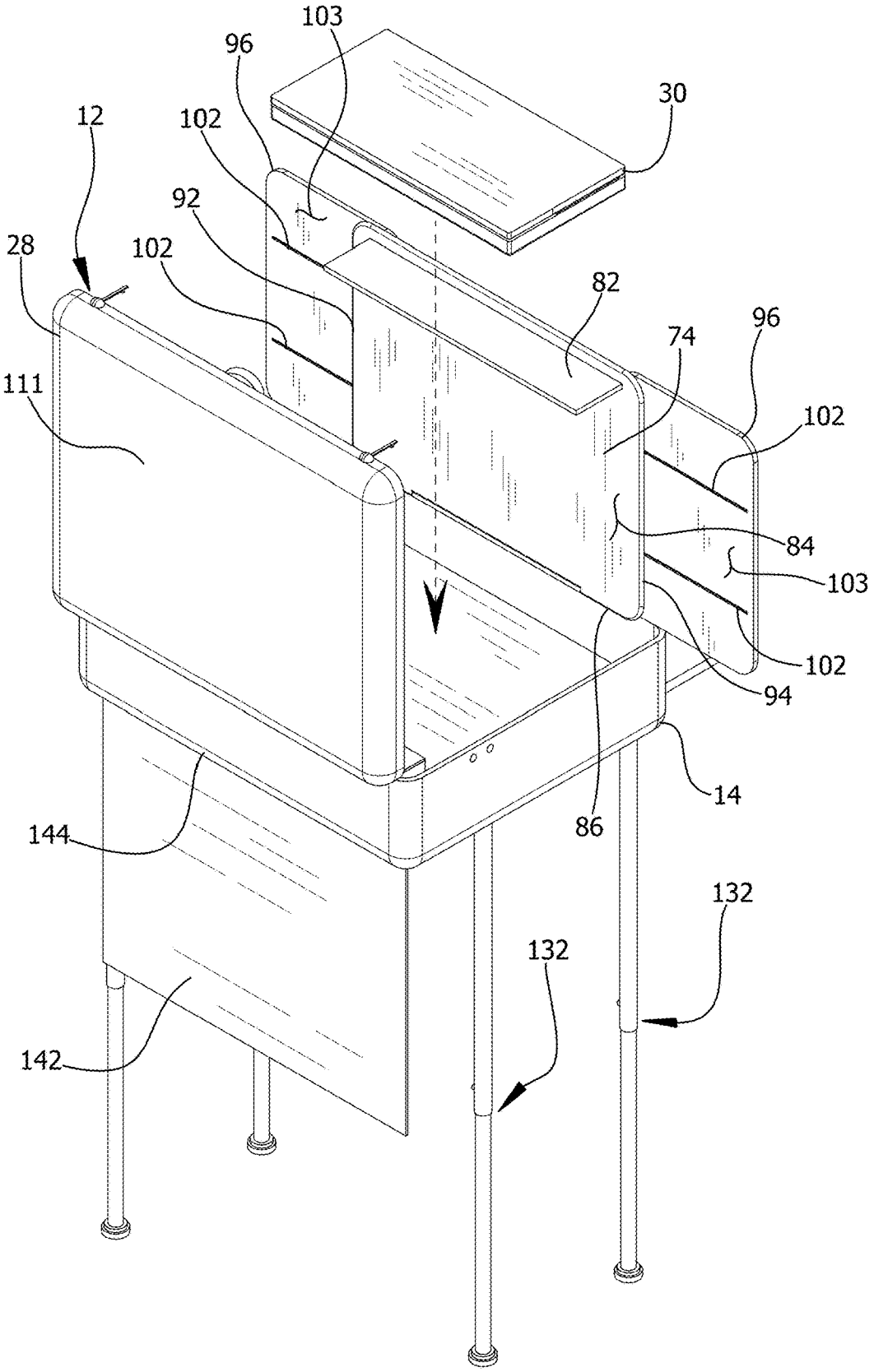
FIG. 2 is a top perspective view of an embodiment of the disclosure showing a work table positioned in a second position and a laptop computer being positioned in a briefcase for storage.
Figure 3:
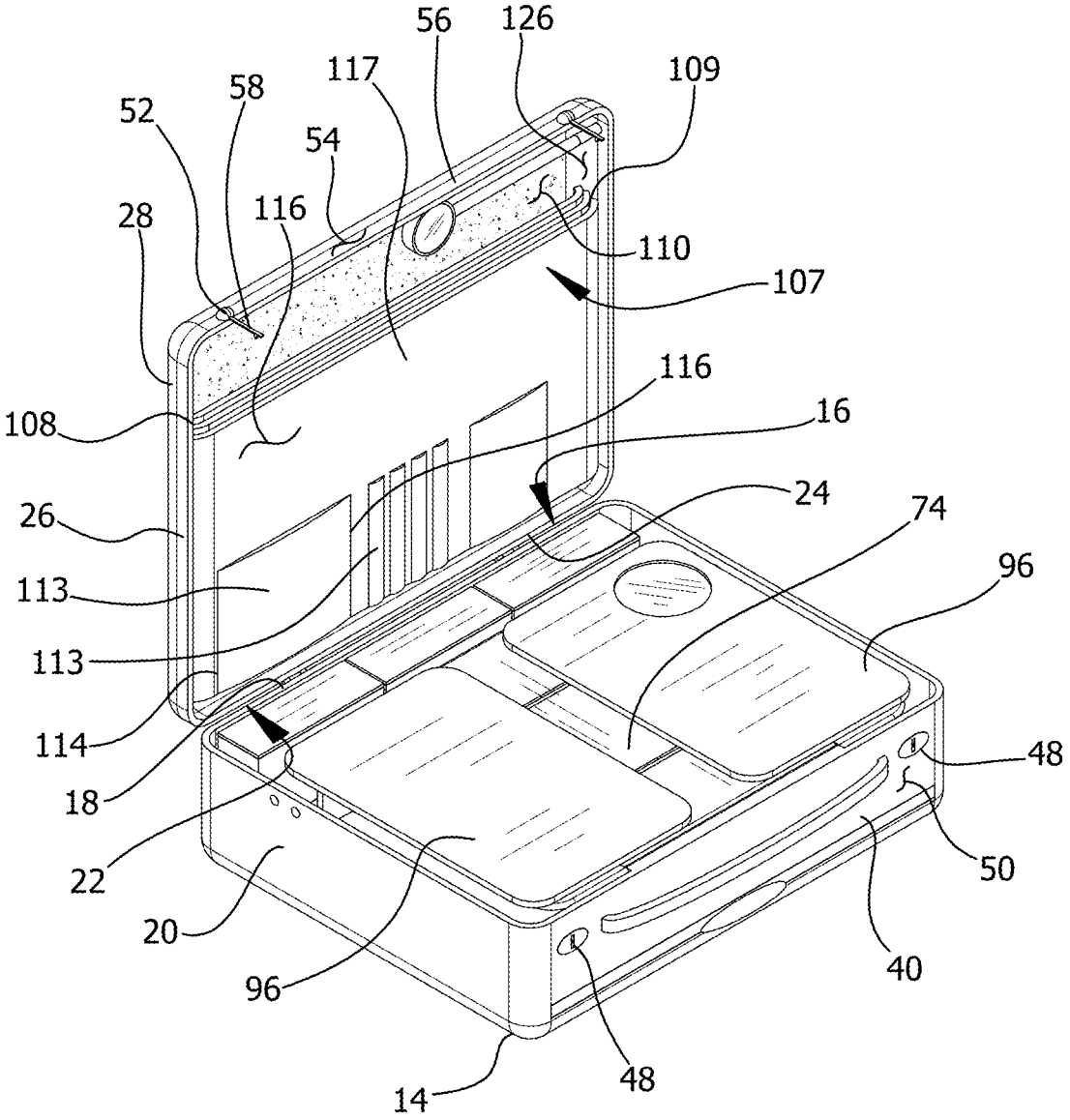
FIG. 3 is a top perspective view of an embodiment of the disclosure showing a work table in a first position and a pair of extension tables in a stored position.
Figure 4:
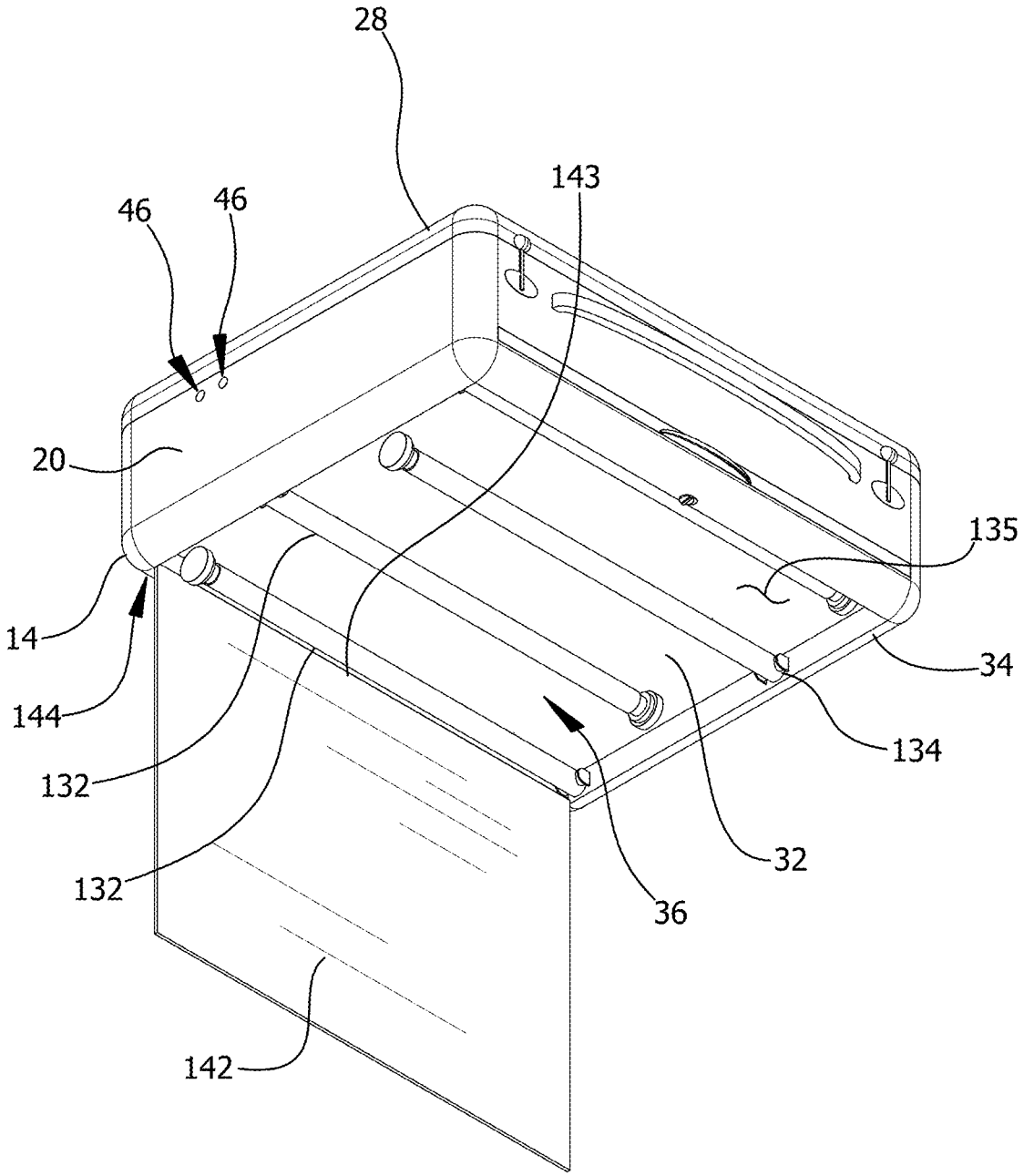
FIG. 4 is a bottom perspective view of an embodiment of the disclosure showing a cover in an open position.
Figure 5:
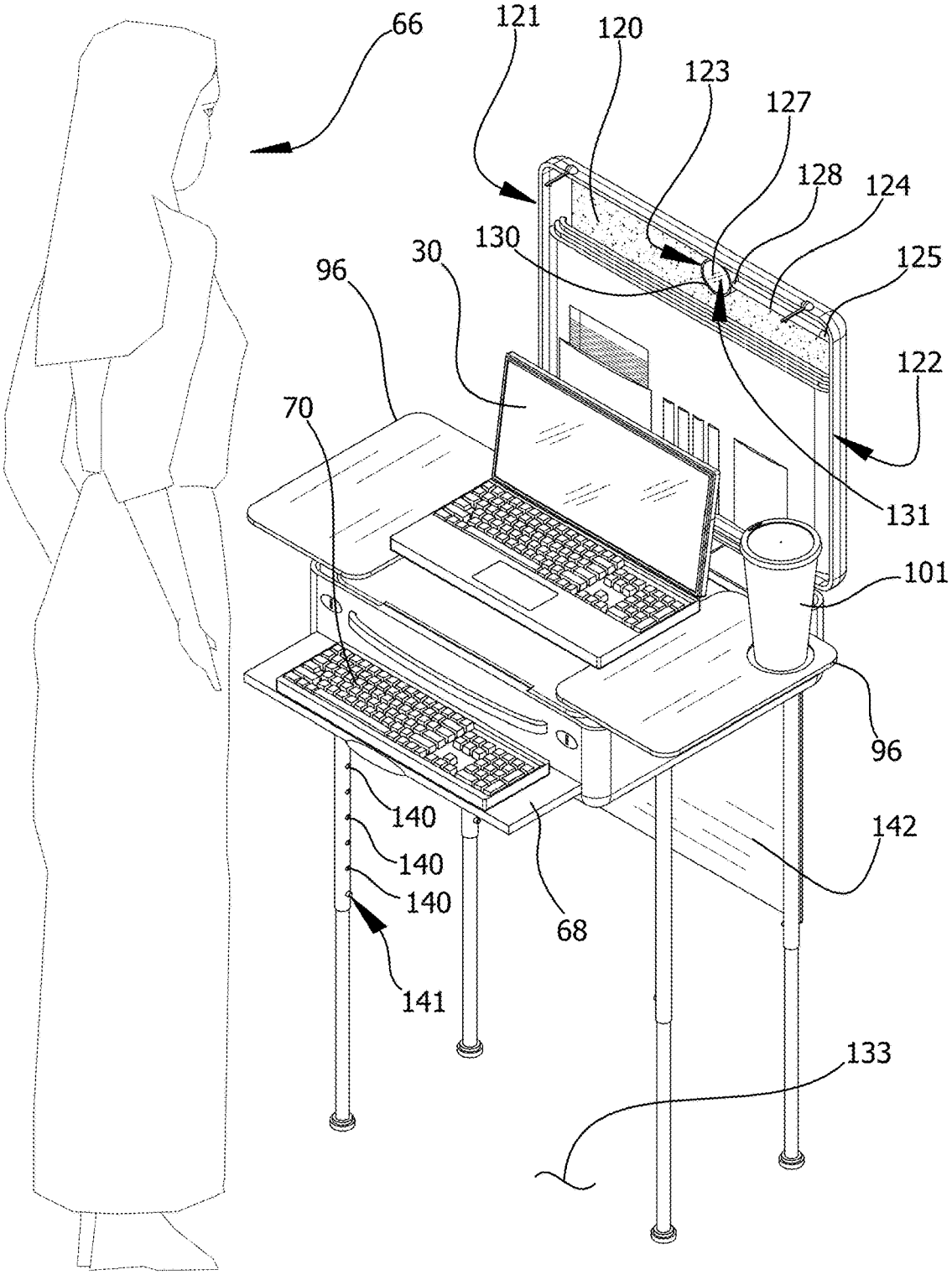
FIG. 5 is a perspective in-use view of an embodiment of the disclosure.
Figure 6:
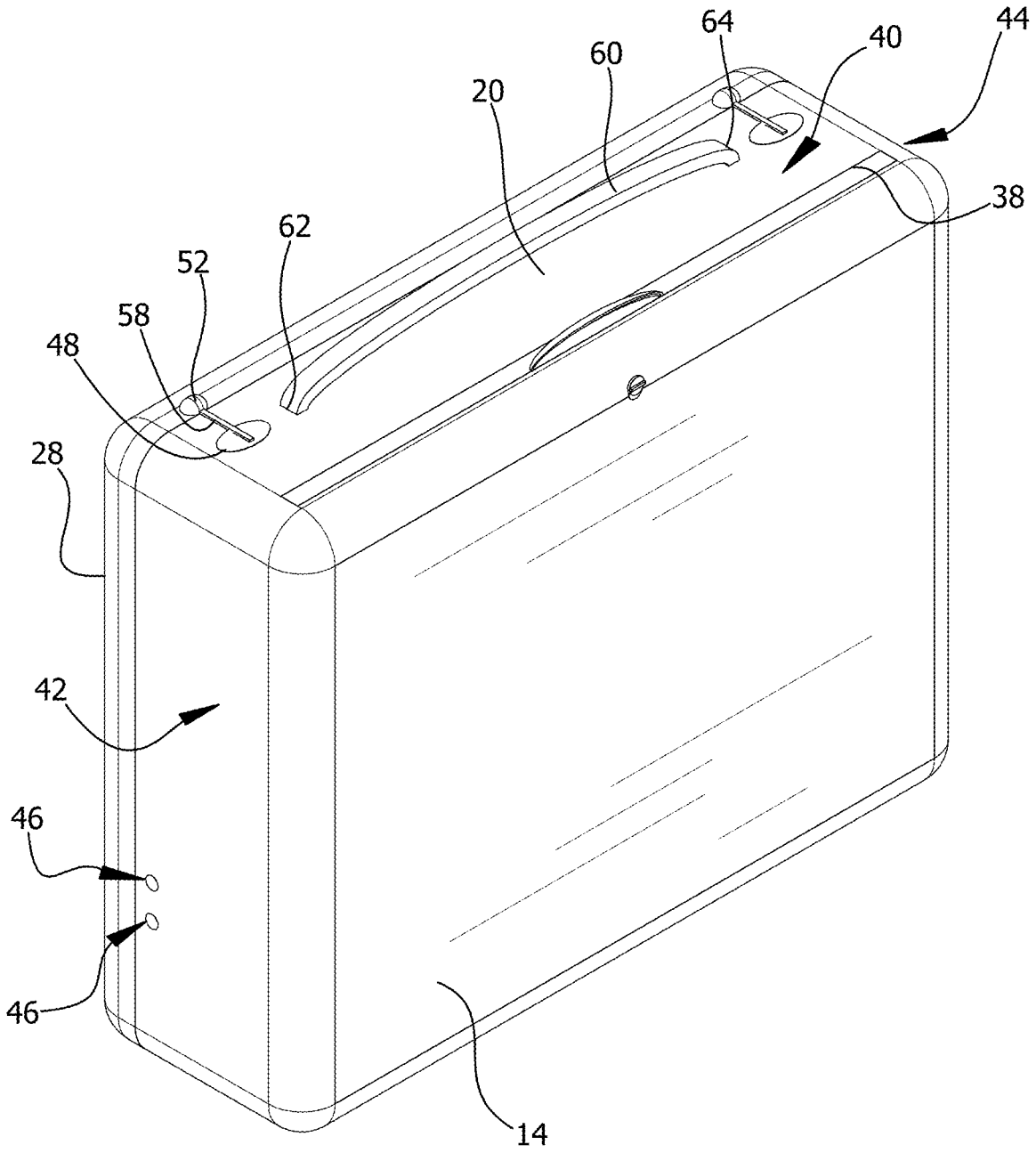
FIG. 6 is a perspective view of an embodiment of the disclosure showing a briefcase being closed.

With reference now to the drawings, and in particular to FIGS. 1 through 6 thereof, a new work desk device embodying the principles and concepts of an embodiment of the disclosure and generally designated by the reference numeral 10 will be described.

As best illustrated in FIGS. 1 through 6, the portable work desk device 10 generally comprises a briefcase 12 which has a width of no greater than 50.0 cm. In this way the briefcase 12 can conform to carryon luggage requirements for airlines. The briefcase 12 has a bottom shell 14 and a rear side 16 of a top edge 18 of an outer wall 20 of the bottom shell 14 is hingedly coupled to a back side 22 of a lower edge 24 of an outer wall 26 of a top shell 28. The lower edge 24 of the outer wall 26 of the top shell 28 rests on the top edge 18 of the outer wall 20 of the bottom shell 14 when the briefcase 12 is closed. Conversely, the top edge 18 of the outer wall 20 of the bottom shell 14 lies on a plane which is oriented parallel to the lower edge 24 of the outer wall 26 of the top shell 28 when the briefcase 12 is open. Additionally, the outer wall 20 of the bottom shell 14 has a height which is greater than a height of the outer wall 26 of the top shell 28 such that an interior space in the bottom shell 14 defined by the outer wall 20 of the bottom shell 14 has dimensions sufficient to store a laptop computer 30.

The bottom shell 14 has a bottom wall 32 which is spaced upwardly from a lower edge 34 of the outer wall 20 of the bottom shell 14 to define a recess 36 which is bounded by the outer wall 20 of the bottom shell 14. The bottom shell 14 has a slot 38 extending through a front side 40 of the outer wall 20 of the bottom shell 14 and the slot 38 is located adjacent to the lower edge 34 of the outer wall 20 of the bottom shell 14. Additionally, the slot 38 is elongated to extend substantially between a first lateral side 42 and a second lateral side 44 of the outer wall 20 of the bottom shell 14 and the slot 38 is spaced upwardly from the bottom wall 32 of the bottom shell 14. The bottom shell 14 has a pair of cord holes 46 each extending through the first lateral side 42 of the outer wall 20 of the bottom shell 14 to accommodate cords associated with the laptop computer 30.

A pair of lock engagements 48 is each disposed on an outwardly facing surface 50 of the front side 40 of the outer wall 20 of the bottom shell 14. Each of the pair of lock engagements 48 is spaced from a respective one of the first lateral side 42 and the second lateral side 44 of the outer wall 20 of the bottom shell 14. A pair of locks 52 is each coupled to an outwardly facing surface 54 of a front side 56 of the outer wall 26 of the top shell 28. Each of the pair of locks 52 includes a finger 58 which extends away from the lower edge 24 of the outer wall 26 of the top shell 28. The finger 58 of each of the pair of locks 52 releasably engages a respective one of the pair of lock engagements 48 when the briefcase 12 is closed for retaining the briefcase 12 in a closed position. Conversely, the finger 58 of each of the locks 52 is releasable from the respective lock engagement 48 to enable the briefcase 12 to be opened. A handle 60 is included which has a first end 62 and a second end 64 each being coupled to the outwardly facing surface 50 of the front side 40 of the outer wall 20 of the bottom shell 14. The handle 60 curves outwardly from the outwardly facing surface 50 of the front side 40 of the outer wall 20 of the bottom shell 14 thereby enabling the handle 60 to be gripped by a user 66 to carry the briefcase 12. Additionally, the handle 60 is located between the pair of lock engagements 48.

A keyboard table 68 is provided and the keyboard table 68 is slidably integrated into the bottom shell 14. The keyboard table 68 is positionable in a stored position having the keyboard table 68 being contained within the bottom shell 14. Conversely, the keyboard table 68 is positionable in a deployed position having the keyboard table 68 extending forwardly from the bottom shell 14 to support a keyboard 70 for the user 66 to employ. The keyboard table 68 is positioned in the slot 38 in the front side of the outer wall 20 of the bottom shell 14 and the keyboard table 68 extends outwardly from the front side 40 of the outer wall 20 of the bottom shell 14 when the keyboard table 68 is in the stored position. Conversely, a front edge 71 of the keyboard table 68 is aligned with the front side 40 of the outer wall 20 of the bottom shell 14 when the keyboard table 68 is in the stored position. The keyboard table 68 includes a grip 72 which is coupled to the front edge 71 of the keyboard table 68 which can be gripped by the user 66 for urging the keyboard table 68 between the stored position and the deployed position.

A work table 74 is provided and the work table 74 is hingedly attached to the bottom shell 14 of the briefcase 12. The work table 74 is positionable in a first position having the work table 74 lying on a horizontal plane such that the work table 74 defines a work surface 76. Furthermore, the work table 74 enables the user 66 to position the laptop computer 30 on the work surface 76. The work table 74 is positionable in a second position having the work table 74 extending upwardly from the bottom shell 14 to access an interior of the bottom shell 14. The work table 74 has a forward edge 78 which is hingedly coupled to a front side 80 of the top edge 18 of the outer wall 20 of the bottom shell 14. The work table 74 has a foot 82 which is coupled to and extends downwardly from a lower surface 84 of the work table 74 at a point located adjacent to a rear edge 86 of the work table 74. The foot 82 rests upon the bottom wall 32 of the bottom shell 14 when the work table 74 is in the first position for retaining the work table 74 on a horizontal plane. Additionally, the rear edge 86 of the work table 74 is spaced from the rear side 16 of the outer wall 20 of the bottom shell 14 when the work table 74 is in the first position.

A pair of tracks 88 is each integrated into an upper surface 90 of the work table 74. Each of the pair of tracks 88 is elongated to extend substantially between a first lateral edge 92 and a second lateral edge 94 of the work table 74. Additionally, each of the pair of tracks 88 is spaced from and is oriented parallel to a respective one of the forward edge 78 and the rear edge 86 of the work table 74. A pair of extension tables 96 is each slidably attached to the work table 74. Each of the pair of extension tables 96 is positionable in a stored position having each of the pair of extension tables 96 located on top of the work table 74 thereby enabling the briefcase 12 to be closed. Conversely, each of the pair of extension tables 96 is positionable in a deployed position having each of the pair of extension tables 96 extending laterally beyond the work table 74 in opposite directions from each other to support work related objects of the user 66. A respective one of the pair of extension tables 96 has a cup holder 98 which is recessed into a top surface 100 of the respective extension table 96 to receive a cup 101 for storing the cup 101.

A plurality of rails 102 is provided and each of the plurality of rails 102 is attached to a bottom surface 103 of a respective one of the pair of extension tables 96. Each of the plurality of rails 102 is oriented on the bottom surface 103 of the respective extension table 96 to enable each of the plurality of rails 102 to slidably engage a respective one of the pair of tracks 88 on the upper surface 90 of the work table 74. In this way the each of the pair of extension tables 96 is slidably retained on the work table 74. Each of the tracks 88 are recessed into the upper surface 90 of the work table 74 and each of the rails 102 extends into the respective track 88. In this way the pair of tracks 88 do not inhibit the laptop computer 30 from lying flat on the upper surface 90 of the workable. Furthermore, each of the tracks 88 may include a pair of channels that each extend laterally in opposite directions from each other and each of the rails 102 may include tabs that are each positioned in a respective channel of the respective track 88 to inhibit the rails 102 from being lifted out of the respective track 88.

A plurality of storage boxes 104 is each positioned in the bottom shell 14 of the briefcase 12 to store objects for the user 66 to employ. Each of the plurality of storage boxes 104 is positioned between the rear edge 86 of the work table 74 and the rear side 16 of the outer wall 20 of the bottom shell 14. Additionally, the plurality of storage boxes 104 is distributed between the first lateral side 42 and the second lateral side 44 of the outer wall 20 of the bottom shell 14. Each of the plurality of storage boxes 104 has a top side 105 which is open into an interior of the storage boxes 104. A plurality of lids 106 is each positionable on the top side 105 of a respective one of the plurality of storage boxes 104 for closing the respective storage box 104.

A plurality of file folders 107 is each attached to the top shell 28 to store documents. Each of the plurality of file folders 107 has a first lateral edge 108 and a second lateral edge 109 that is coupled to a bottom surface 110 of a top wall 111 of the top shell 28. The file folders 107 are positioned on top of each other and are spaced from each other to enable the documents to be positioned between respective pairs of the plurality of file folders 107. An upper edge 112 of each of the plurality of file folders 107 is spaced from the front side 56 of the outer wall 26 of the top shell 28. A plurality of pockets 113 each has a first edge 114 and a second edge 115 which is each coupled to a front surface 116 of a forwardmost one of the plurality of file folders 117. Each of the plurality of pockets 113 has an upper edge 118 which is spaced from the front surface 116 of the forwardmost file folder 117 to define an opening 119 into the pockets 113 to insertably receive objects for storage. A cork board 120 is attached to the bottom surface 110 of the top wall 111 of the top shell 28 to enable pieces of paper to be pinned to the cork board 120. The cork board 120 is positioned between the upper edge 112 of the plurality of file folders 107 and the front side 56 of the outer wall 26 of the top shell 28. Additionally, the cork board 120 extends between a first lateral side 121 and a second lateral side 122 of the outer wall 26 of the top shell 28.

A light 123 is attached to the top shell 28 to emit light outwardly from the top shell 28 for illuminating the work table 74. The light 123 includes a stem 124 which has a first end 125 that is coupled to an inwardly facing surface 126 of the second lateral side 122 of the outer wall 26 of the top shell 28. The light 123 includes a light emitter 127 which is attached to a second end 128 of the stem 124. The light emitter 127 may comprise a light emitting diode or the like and the light 123 may include a circular housing 130 which houses the light emitter 127 and a translucent lens 131 applied to the circular housing 130 which covers the light emitter 127.

A plurality of legs 132 is each pivotally attached to the bottom shell 14 of the briefcase 12. Each of the plurality of legs 132 is positionable in a deployed position having each of the plurality of legs 132 extending downwardly from the bottom shell 14 to support the bottom shell 14 above a support surface 133. The support surface 133 may be a floor of a room, for example, or other type of horizontal support surface. Each of the plurality of legs 132 is positionable in a stored position having the plurality of legs 132 resting against the bottom shell 14. Each of the plurality of legs 132 has an upper end 134 which is pivotally attached to a lower surface 135 of the bottom wall 32 of the bottom shell 14. Furthermore, each of the plurality of legs 132 is positioned in the recess 36 which is bound by the outer wall 20 of the bottom shell 14.

Each of the plurality of legs 132 comprises an upper section 136 which slidably receives a lower section 137 such that each of the plurality of legs 132 has a telescopically adjustable length. Each of the plurality of legs 132 includes a foot 138 which is attached to a bottom end 139 of the legs 132 and the foot 138 on the bottom end 139 of each of the plurality of legs 132 rests upon the support surface 133 when the plurality of legs 132 is in the deployed position. Each of the plurality of legs 132 has a plurality of holes 140 each extending through the upper section 136. The plurality of holes 140 in each of the plurality of legs 132 is evenly spaced apart from each other and is distributed along the upper section 136. Additionally, each of the plurality of legs 132 includes a lock 141 which is movably attached to the lower section 137. The lock 141 on the lower section 137 of a respective one of the plurality of legs 132 extends through a respective one of the plurality of holes 140 in the upper section 136 of the respective leg 132 for retaining the respective leg 132 at a desired length. Furthermore, the lock 141 on the lower section 137 of each of the plurality of legs 132 may comprise a ball that is spring biased to extend outwardly from the lower section 137 of the respective leg 132.

A cover 142 is included which has a rear edge 143 that is hingedly coupled to a rear side 144 of the lower edge 34 of the outer wall 20 of the bottom shell 14. The cover 142 is positionable in an open position having the cover 142 exposing the recess 36 which is bound by the outer wall 20 of the bottom shell 14. In this way the cover 142 enables the plurality of legs 132 to be positioned in the deployed position. Conversely, the cover 142 is positionable in a closed position having the cover 142 closing the recess 36 which is bound by the outer wall 20 of the bottom shell 14. In this way the cover 142 retains the plurality of legs 132 in the stored position.

In use, the laptop computer 30 is positioned in the bottom shell 14 of the briefcase 12 and the work table 74 is positioned in the first position to cover the laptop computer 30 and each of the extension tables 96 is positioned stored position to enable the briefcase 12 to be closed. In this way the laptop computer 30 and documents stored in the file folders 107 can be transported on a commercial aircraft, for example, while the user 66 is traveling. The cover 142 positioned in the open position and each of the plurality of legs 132 is positioned in the deployed position to support the briefcase 12 above the support surface 133. The briefcase 12 is opened, the work table 74 is positioned in the second position to enable the laptop computer 30 to be removed from the bottom shell 14, the work table 74 is positioned in the first position and each of the extension tables 96 is positioned in the deployed position and the laptop computer 30 is placed upon the work table 74. In this way the user 66 can employ the laptop computer 30 as though the user 66 were sitting at a traditional work desk while the user 66 is travelling thereby enhancing the user's 66 ability to be productive and to enable the user 66 to enjoy healthy ergonomics while employing the laptop computer 30. Additionally, the keyboard table 68 can be positioned in the deployed position to support the keyboard 70 if the user 66 wishes to employ a keyboard that is separate from the laptop computer 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable work desk device comprising:

a briefcase having a width of no greater than 50.0 cm wherein said briefcase is configured to conform to carryon luggage requirements for airlines, said briefcase comprising a bottom shell being hingedly coupled to a top shell;

a keyboard table being slidably integrated into said bottom shell, said keyboard table being positionable in a stored position having said keyboard table being contained within said bottom shell, said keyboard table being positionable in a deployed position having said keyboard table extending forwardly from said bottom shell wherein said keyboard table is configured to support a keyboard for a user to employ;

a work table being hingedly attached to said bottom shell of said briefcase, said work table being positionable in a first position having said work table lying on a horizontal plane such that said work table defines a work surface wherein said work table is configured to enable the user to position a laptop computer on said work surface, said work table being positionable in a second position having said work table extending upwardly from said bottom shell to access an interior of said bottom shell;

a pair of extension tables, each of said pair of extension tables being slidably attached to said work table, each of said pair of extension tables being positionable in a stored position having each of said pair of extension tables located on top of said work table thereby enabling said briefcase to be closed, each of said pair of extension tables being positionable in a deployed position having each of said pair of extension tables extending laterally beyond said work table in opposite directions from each other wherein each of said pair of extension tables is configured to support work related objects of the user;

a plurality of storage boxes, each of said plurality of storage boxes is positioned in said bottom shell of said briefcase wherein said storage boxes are configured to store objects for the user to employ;

a plurality of file folders, each of said plurality of file folders being attached to said top shell wherein each of said plurality of file folders is configured to store documents;

a light being attached to said top shell wherein said light is configured to emit light outwardly from said top shell for illuminating said work table; and a plurality of legs, each of said plurality of legs being pivotally attached to said bottom shell of said briefcase, each of said plurality of legs being positionable in a deployed position having each of said plurality of legs extending downwardly from said bottom shell wherein said plurality of legs is configured to support said bottom shell above a support surface, each of said plurality of legs being positionable in a stored position having said plurality of legs resting against said bottom shell.

2. The device according to claim 1, wherein:

said briefcase has a bottom shell having a rear side of a top edge of an outer wall being hingedly coupled to a back side of a lower edge of an outer wall of a top shell;

said lower edge of said outer wall of said top shell rests on said top edge of said outer wall of said bottom shell when said briefcase is closed;

said top edge of said outer wall of said bottom shell lies on a plane being oriented parallel to said lower edge of said outer wall of said top shell when said briefcase is open;

said outer wall of said bottom shell has a height being greater than a height of said outer wall of said top shell such that an interior space in said bottom shell defined by said outer wall of said bottom shell has dimensions being configured to store a laptop computer;

said bottom shell has a bottom wall being spaced upwardly from a lower edge of said outer wall of said bottom shell to define a recess being bounded by said outer wall of said bottom shell;

said bottom shell has a slot extending through a front side of said outer wall of said bottom shell;

said slot is located adjacent to said lower edge of said outer wall of said bottom shell;

said slot is elongated to extend substantially between a first lateral side and a second lateral side of said outer wall of said bottom shell;

said slot is spaced upwardly from said bottom wall of said bottom shell; and said bottom shell has a pair of cord holes each extending through said first lateral side of said outer wall of said bottom shell wherein each of said pair of cord holes is configured to accommodate cords associated with the laptop computer.

3. The device according to claim 2, wherein:

said device includes a pair of lock engagements;

each of said pair of lock engagements is disposed on an outwardly facing surface of said front side of said outer wall of said bottom shell;

each of said pair of lock engagements is spaced from a respective one of said first lateral side and said second lateral side of said outer wall of said bottom shell;

said device includes a pair of locks;

each of said pair of locks is coupled to an outwardly facing surface of a front side of said outer wall of said top shell;

each of said pair of locks includes a finger which extends away from said lower edge of said outer wall of said top shell;

said finger of each of said pair of locks releasably engages a respective one of said pair of lock engagements when said briefcase is closed for retaining said briefcase in a closed position; and said finger of each of said locks is releasable from said respective lock engagement to enable said briefcase to be opened.

4. The device according to claim 2, wherein:

said keyboard table is positioned in said slot in said front side of said outer wall of said bottom shell;

said keyboard table extends outwardly from said front side of said outer wall of said bottom shell when said keyboard table is in said stored position;

a front edge of said keyboard table is aligned with said front side of said outer wall of said bottom shell when said keyboard table is in said stored position; and said keyboard table includes a grip being coupled to said front edge of said keyboard table wherein said grip is configured to be gripped by the user for urging said keyboard table between said stored position and said deployed position.

5. The device according to claim 2, wherein:

said work table has a forward edge being hingedly coupled to a front side of said top edge of said outer wall of said bottom shell;

said work table has a foot being coupled to and extending downwardly from a lower surface of said work table at a point located adjacent to a rear edge of said work table;

said foot rests upon said bottom wall of said bottom shell when said work table is in said first position for retaining said work table on a horizontal plane; and said rear edge of said work table is spaced from said rear side of said outer wall of said bottom shell when said work table is in said first position.

6. The device according to claim 1, wherein:

said device includes a pair of tracks;

each of said pair of tracks is integrated into an upper surface of said work table;

each of said pair of tracks is elongated to extend substantially between a first lateral edge and a second lateral edge of said work table;

each of said pair of tracks is spaced from and is oriented parallel to a respective one of said forward edge and said rear edge of said work table;

said device includes a plurality of rails;

each of said plurality of rails is attached to a bottom surface of a respective one of said pair of extension tables; and each of said plurality of rails is oriented on said bottom surface of said respective extension table to enable each of said plurality of rails to slidably engage a respective one of said pair of tracks on said upper surface of said work table for slidably retaining each of said pair of extension tables on said work table.

7. The device according to claim 1, wherein:

each of said plurality of storage boxes is positioned between a rear edge of said work table and a rear side of an outer wall of said bottom shell;

said plurality of storage boxes is distributed between a first lateral side and a second lateral side of said outer wall of said bottom shell;

each of said plurality of storage boxes has a top side being open into an interior of said storage boxes;

said device includes a plurality of lids; and each of said plurality of lids is positionable on said top side of a respective one of said plurality of storage boxes for closing said respective storage box.

8. The device according to claim 1, wherein:

each of said plurality of file folders has a first lateral edge and a second lateral edge being coupled to a bottom surface of a top wall of said top shell;

said plurality of file folders being positioned on top of each other and being spaced from each other wherein said plurality of file folders is configured to enable the documents to be positioned between respective pairs of said plurality of file folders;

an upper edge of each of said plurality of file folders is spaced from a front side of said outer wall of said top shell;

said device includes a plurality of pockets, each of said plurality of pockets has a first edge and a second edge each being coupled to a front surface of a forwardmost one of said plurality of file folders;

each of said plurality of pockets has an upper edge being spaced from said front surface of said forwardmost file folder to define an opening into said pockets wherein said opening in each of said plurality of pockets is configured to insertably receive objects for storage;

said device includes a cork board being attached to said bottom surface of said top wall of said top shell wherein said cork board is configured to enable pieces of paper to be pinned to said cork board;

said cork board is positioned between said upper edge of said plurality of file folders and said front side of said outer wall of said top shell; and said cork board extends between a first lateral side and a second lateral side of said outer wall of said top shell.

9. The device according to claim 2, wherein:

each of said plurality of legs has an upper end being pivotally attached to a lower surface of said bottom wall of said bottom shell such that each of said plurality of legs is positioned in said recess which is bound by said outer wall of said bottom shell;

each of said plurality of legs comprises an upper section which slidably receives a lower section such that each of said plurality of legs has a telescopically adjustable length;

each of said plurality of legs includes a foot being attached to a bottom end of said legs wherein said foot on said bottom end of each of said plurality of legs is configured to rest upon the support surface when said plurality of legs is in said deployed position;

each of said plurality of legs has a plurality of holes each extending through said upper section;

said plurality of holes in each of said plurality of legs is evenly spaced apart from each other and is distributed along said upper section;

each of said plurality of legs includes a lock being movably attached to said lower section; and said lock on said lower section of a respective one of said plurality of legs extends through a respective one of said plurality of holes in said upper section of said respective leg for retaining said respective leg at a desired length.

10. The device according to claim 2, wherein:

said device includes a cover having a rear edge being hingedly coupled to a rear side of said lower edge of said outer wall of said bottom shell;

said cover is positionable in an open position having said cover exposing said recess being bound by said outer wall of said bottom shell; and said cover is positionable in a closed position having said cover closing said recess being bound by said outer wall of said bottom shell.

11. A portable work desk device comprising:

a briefcase having a width of no greater than 50.0 cm wherein said briefcase is configured to conform to carryon luggage requirements for airlines, said briefcase comprising a bottom shell being hingedly coupled to a top shell, a rear side of a top edge of an outer wall of said bottom shell being hingedly coupled to a back side of a lower edge of an outer wall of said top shell, said lower edge of said outer wall of said top shell resting on said top edge of said outer wall of said bottom shell when said briefcase is closed, said top edge of said outer wall of said bottom shell lying on a plane being oriented parallel to said lower edge of said outer wall of said top shell when said briefcase is open, said outer wall of said bottom shell having a height being greater than a height of said outer wall of said top shell such that an interior space in said bottom shell defined by said outer wall of said bottom shell has dimensions being configured to store a laptop computer, said bottom shell having a bottom wall being spaced upwardly from a lower edge of said outer wall of said bottom shell to define a recess being bounded by said outer wall of said bottom shell, said bottom shell having a slot extending through a front side of said outer wall of said bottom shell, said slot being located adjacent to said lower edge of said outer wall of said bottom shell, said slot being elongated to extend substantially between a first lateral side and a second lateral side of said outer wall of said bottom shell, said slot being spaced upwardly from said bottom wall of said bottom shell, said bottom shell having a pair of cord holes each extending through said first lateral side of said outer wall of said bottom shell wherein each of said pair of cord holes is configured to accommodate cords associated with the laptop computer;

a pair of lock engagements, each of said pair of lock engagements being disposed on an outwardly facing surface of said front side of said outer wall of said bottom shell, each of said pair of lock engagements being spaced from a respective one of said first lateral side and said second lateral side of said outer wall of said bottom shell;

a pair of locks, each of said pair of locks being coupled to an outwardly facing surface of a front side of said outer wall of said top shell, each of said pair of locks including a finger which extends away from said lower edge of said outer wall of said top shell, said finger of each of said pair of locks releasably engaging a respective one of said pair of lock engagements when said briefcase is closed for retaining said briefcase in a closed position, said finger of each of said locks being releasable from said respective lock engagement to enable said briefcase to be opened;

a handle having a first end and a second end each being coupled to said outwardly facing surface of said front side of said outer wall of said bottom shell, said handle curving outwardly from said outwardly facing surface of said front side of said outer wall of said bottom shell wherein said handle is configured to be gripped by a user to enable to user to carry said briefcase, said handle being located between said pair of lock engagements;

a keyboard table being slidably integrated into said bottom shell, said keyboard table being positionable in a stored position having said keyboard table being contained within said bottom shell, said keyboard table being positionable in a deployed position having said keyboard table extending forwardly from said bottom shell wherein said keyboard table is configured to support a keyboard for the user to employ, said keyboard table being positioned in said slot in said front side of said outer wall of said bottom shell, said keyboard table extending outwardly from said front side of said outer wall of said bottom shell when said keyboard table is in said stored position, a front edge of said keyboard table being aligned with said front side of said outer wall of said bottom shell when said keyboard table is in said stored position, said keyboard table including a grip being coupled to said front edge of said keyboard table wherein said grip is configured to be gripped by the user for urging said keyboard table between said stored position and said deployed position;

a work table being hingedly attached to said bottom shell of said briefcase, said work table being positionable in a first position having said work table lying on a horizontal plane such that said work table defines a work surface wherein said work table is configured to enable the user to position the laptop computer on said work surface, said work table being positionable in a second position having said work table extending upwardly from said bottom shell to access an interior of said bottom shell, said work table having a forward edge being hingedly coupled to said front side of said top edge of said outer wall of said bottom shell, said work table having a foot being coupled to and extending downwardly from a lower surface of said work table at a point located adjacent to a rear edge of said work table, said foot resting upon said bottom wall of said bottom shell when said work table is in said first position for retaining said work table on a horizontal plane, said rear edge of said work table being spaced from said rear side of said outer wall of said bottom shell when said work table is in said first position;

a pair of tracks, each of said pair of tracks being integrated into an upper surface of said work table, each of said pair of tracks being elongated to extend substantially between a first lateral edge and a second lateral edge of said work table, each of said pair of tracks being spaced from and being oriented parallel to a respective one of said forward edge and said rear edge of said work table;

a pair of extension tables, each of said pair of extension tables being slidably attached to said work table, each of said pair of extension tables being positionable in a stored position having each of said pair of extension tables located on top of said work table thereby enabling said briefcase to be closed, each of said pair of extension tables being positionable in a deployed position having each of said pair of extension tables extending laterally beyond said work table in opposite directions from each other wherein each of said pair of extension tables is configured to support work related objects of the user, a respective one of said pair of extension tables having a cup holder being recessed into a top surface of said respective extension table wherein said cup holder is configured to receive a cup for storing the cup;

a plurality of rails, each of said plurality of rails being attached to a bottom surface of a respective one of said pair of extension tables, each of said plurality of rails being oriented on said bottom surface of said respective extension table to enable each of said plurality of rails to slidably engage a respective one of said pair of tracks on said upper surface of said work table for slidably retaining each of said pair of extension tables on said work table;

a plurality of storage boxes, each of said plurality of storage boxes being positioned in said bottom shell of said briefcase wherein said storage boxes are configured to store objects for the user to employ, each of said plurality of storage boxes being positioned between said rear edge of said work table and said rear side of said outer wall of said bottom shell, said plurality of storage boxes being distributed between said first lateral side and said second lateral side of said outer wall of said bottom shell, each of said plurality of storage boxes having a top side being open into an interior of said storage boxes;

a plurality of lids, each of said plurality of lids being positionable on said top side of a respective one of said plurality of storage boxes for closing said respective storage box;

a plurality of file folders, each of said plurality of file folders being attached to said top shell wherein each of said plurality of file folders is configured to store documents, each of said plurality of file folders having a first lateral edge and a second lateral edge being coupled to a bottom surface of a top wall of said top shell, said plurality of file folders being positioned on top of each other and being spaced from each other wherein said plurality of file folders is configured to enable the documents to be positioned between respective pairs of said plurality of file folders, an upper edge of each of said plurality of file folders being spaced from said front side of said outer wall of said top shell;

a plurality of pockets, each of said plurality of pockets having a first edge and a second edge each being coupled to a front surface of a forwardmost one of said plurality of file folders, each of said plurality of pockets having an upper edge being spaced from said front surface of said forwardmost file folder to define an opening into said pockets wherein said opening in each of said plurality of pockets is configured to insertably receive objects for storage;

a cork board being attached to said bottom surface of said top wall of said top shell wherein said cork board is configured to enable pieces of paper to be pinned to said cork board, said cork board being positioned between said upper edge of said plurality of file folders and said front side of said outer wall of said top shell, said cork board extending between a first lateral side and a second lateral side of said outer wall of said top shell;

a light being attached to said top shell wherein said light is configured to emit light outwardly from said top shell for illuminating said work table, said light including a stem having a first end being coupled to an inwardly facing surface of said second lateral side of said outer wall of said top shell, said light including a light emitter being attached to a second end of said stem;

a plurality of legs, each of said plurality of legs being pivotally attached to said bottom shell of said briefcase, each of said plurality of legs being positionable in a deployed position having each of said plurality of legs extending downwardly from said bottom shell wherein said plurality of legs is configured to support said bottom shell above a support surface, each of said plurality of legs being positionable in a stored position having said plurality of legs resting against said bottom shell, each of said plurality of legs having an upper end being pivotally attached to a lower surface of said bottom wall of said bottom shell such that each of said plurality of legs is positioned in said recess which is bound by said outer wall of said bottom shell, each of said plurality of legs comprising an upper section which slidably receives a lower section such that each of said plurality of legs has a telescopically adjustable length, each of said plurality of legs including a foot being attached to a bottom end of said legs wherein said foot on said bottom end of each of said plurality of legs is configured to rest upon the support surface when said plurality of legs is in said deployed position, each of said plurality of legs having a plurality of holes each extending through said upper section, said plurality of holes in each of said plurality of legs being evenly spaced apart from each other and being distributed along said upper section, each of said plurality of legs including a lock being movably attached to said lower section, said lock on said lower section of a respective one of said plurality of legs extending through a respective one of said plurality of holes in said upper section of said respective leg for retaining said respective leg at a desired length; and a cover having a rear edge being hingedly coupled to a rear side of said lower edge of said outer wall of said bottom shell, said cover being positionable in an open position having said cover exposing said recess being bound by said outer wall of said bottom shell, said cover being positionable in a closed position having said cover closing said recess being bound by said outer wall of said bottom shell.

* * * * *